US005569051A

United States Patent [19]

Endo et al.

[11] Patent Number: 5,569,051

[45] Date of Patent: Oct. 29, 1996

[54] WATERPROOF CONNECTOR

[75] Inventors: Takayoshi Endo; Takashi Takagishi, both of Shizuoka-ken, Japan

[73] Assignee: Yazaki Corporation, Japan

[21] Appl. No.: 280,671

[22] Filed: Jul. 27, 1994

[30] Foreign Application Priority Data

Aug. 6, 1993 [JP] Japan ..... 5-196181

[51] Int. Cl.[6] ..... H01R 13/40

[52] U.S. Cl. ..... 439/587; 439/752.5

[58] Field of Search ..... 439/752.5, 587, 439/589, 274, 275, 279, 740

[56] References Cited

U.S. PATENT DOCUMENTS

| | | | |
|---|---|---|---|
| 4,497,531 | 2/1985 | Baker | 439/587 |
| 5,240,433 | 8/1993 | Kato | 439/587 |

FOREIGN PATENT DOCUMENTS

| | | |
|---|---|---|
| 0384577 | 8/1990 | European Pat. Off. . |
| 0592102 | 4/1994 | European Pat. Off. . |
| 4224528 | 2/1993 | Germany . |

*Primary Examiner*—Neil Abrams
*Assistant Examiner*—Barry Matthew L. Standig
*Attorney, Agent, or Firm*—Venable, Baetjer, Howard & Civiletti, LLP

[57] ABSTRACT

Disclosed is a waterproof connector which is capable of controlling the inserting posture of the terminal members with respect to the connector housing in the earlier stages of terminal insertion. The waterproof connector includes: a plurality of terminal members having inserting posture controlling protrusions; and a connector housing having a plurality of terminal accommodating chambers for accommodating the terminal members. A waterproof plug which has a plurality of sealing insertion holes corresponding to the terminal accommodating chambers is fitted into the rear section of the connector housing, and a waterproof plug retaining cover is mounted on the rear end section of the housing. The waterproof plug retaining cover has terminal insertion holes corresponding to the sealing insertion holes, and the terminal insertion holes have inserting posture controlling recesses allowing passage of the inserting posture controlling protrusions formed on the terminal members.

9 Claims, 3 Drawing Sheets

WATERPROOF CONNECTOR

BACKGROUND OF THE INVENTION

1. Field of the Invention

This invention relates to a waterproof connector to be used for the connection of an automobile wire harness, etc. and, in particular, to a waterproof connector in which the terminal members to be inserted into the terminal accommodating chambers of the connector housing have inserting posture controlling protrusions.

2. Description of the Related Art

Conventional waterproof connectors of this type includes a plurality of terminal members each having an inserting posture controlling protrusion on the outer surface of its front end section, and a connector housing having a plurality of terminal accommodating chambers for accommodating the terminal members. A waterproof plug fitting chamber is provided on the terminal-insertion side, i.e., the rear side, of the connector housing, and a waterproof plug having a plurality of insertion holes corresponding to the terminal accommodating chambers is fitted into this waterproof plug fitting chamber. Recesses for controlling the inserting posture of the terminal members are formed in the inner surfaces of the terminal accommodating chambers, and the inserting posture controlling protrusions of the terminal members engage with these recesses. By correctly inserting the terminal members into the terminal accommodating chambers while keeping the protrusions of the terminal members in engagement with the recesses of the terminal accommodating chambers, the terminal members are enabled to be reliably secured in the terminal accommodating chambers by a locking means.

Inserting posture controlling marks which are in alignment with the recesses of the terminal accommodating chambers are formed in the peripheral edges of the insertion holes of the waterproof plug. Thus, when performing the terminal member inserting operation with respect to the connector, the operator inserts the terminal members into the insertion holes of the water proof plug while keeping the protrusions of the terminal members in alignment with the marks of the waterproof plug.

However, it often happens that these marks are erroneously read. In such cases, the terminal members once inserted into the insertion holes must be drawn out of the waterproof plug, which is formed of an elastic material like rubber, and inserted again, resulting in a waste of time. (See Japanese Patent Laid-open No. 2-204980).

The present invention has been made in view of the above problem in the prior art.

SUMMARY OF THE INVENTION

It is accordingly an object of this invention to provide a waterproof connector in which any error in the inserting posture of the terminal members with respect to the terminal accommodating chambers of the waterproof connector can be detected in the earlier stages of insertion.

To achieve the above object, in accordance with this invention, there is provided a waterproof connector comprising: a plurality of terminal members having inserting posture controlling protrusions; a connector housing having a plurality of terminal accommodating chambers for accommodating the terminal members; and a waterproof plug which has a plurality of sealing insertion holes corresponding to the terminal accommodating chambers and which is fitted into the rear section of the connector housing, wherein a waterproof plug retaining cover is mounted on the rear end section of the housing, and wherein insertion holes corresponding to the sealing insertion holes are formed in the waterproof plug retaining cover, the insertion holes having inserting posture controlling recesses allowing passage of the inserting posture controlling protrusions formed on the terminal members.

In accordance with the present invention, the terminal members are inserted into the terminal accommodating chambers through the sealing insertion holes of the waterproof plug when the inserting posture controlling protrusions of the terminal members are aligned with the inserting posture controlling recesses of the insertion holes formed in the waterproof plug retaining cover. Thus, there is no fear of the terminal members being erroneously inserted into the insertion holes of the waterproof plug, thereby improving the efficiency of the terminal member inserting operation.

In a preferred embodiment of the present invention, the walls constituting the terminal accommodating chambers have grooves into which the inserting posture controlling protrusions formed on the terminal members are allowed to penetrate, thereby stabilizing the posture of the terminal members inserted into the terminal accommodating chambers.

Other objects and advantages of the present invention will become apparent from the following description of an embodiment with reference to the accompanying drawings.

DESCRIPTION OF THE PREFERRED EMBODIMENT

Figure 1:
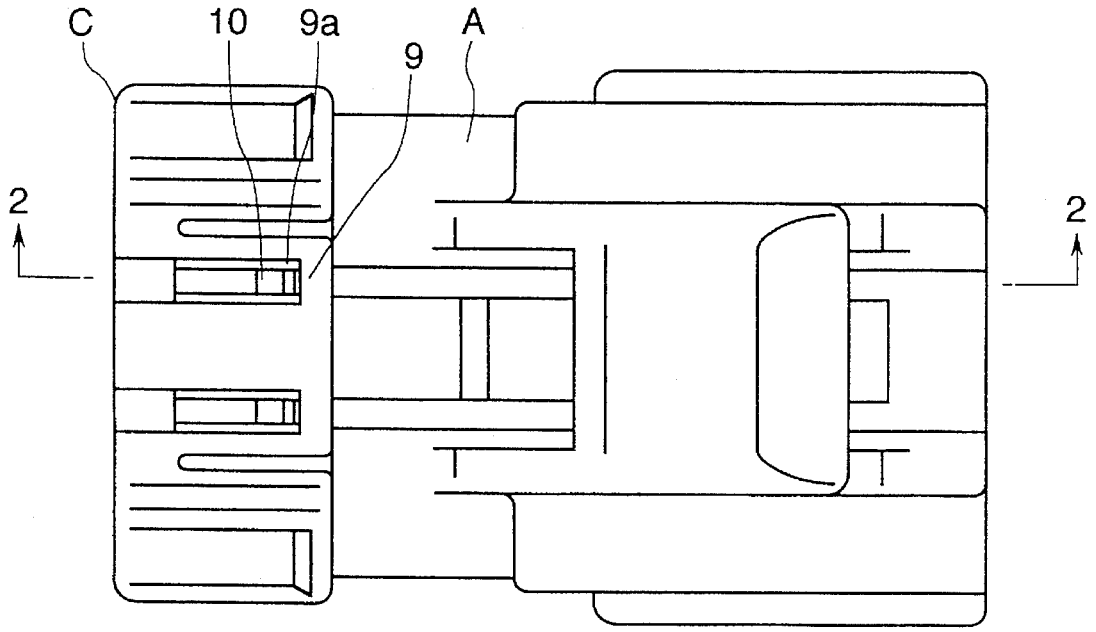
FIG. 1 is a plan view of a waterproof connector according to an embodiment of the present invention.
Figure 2:
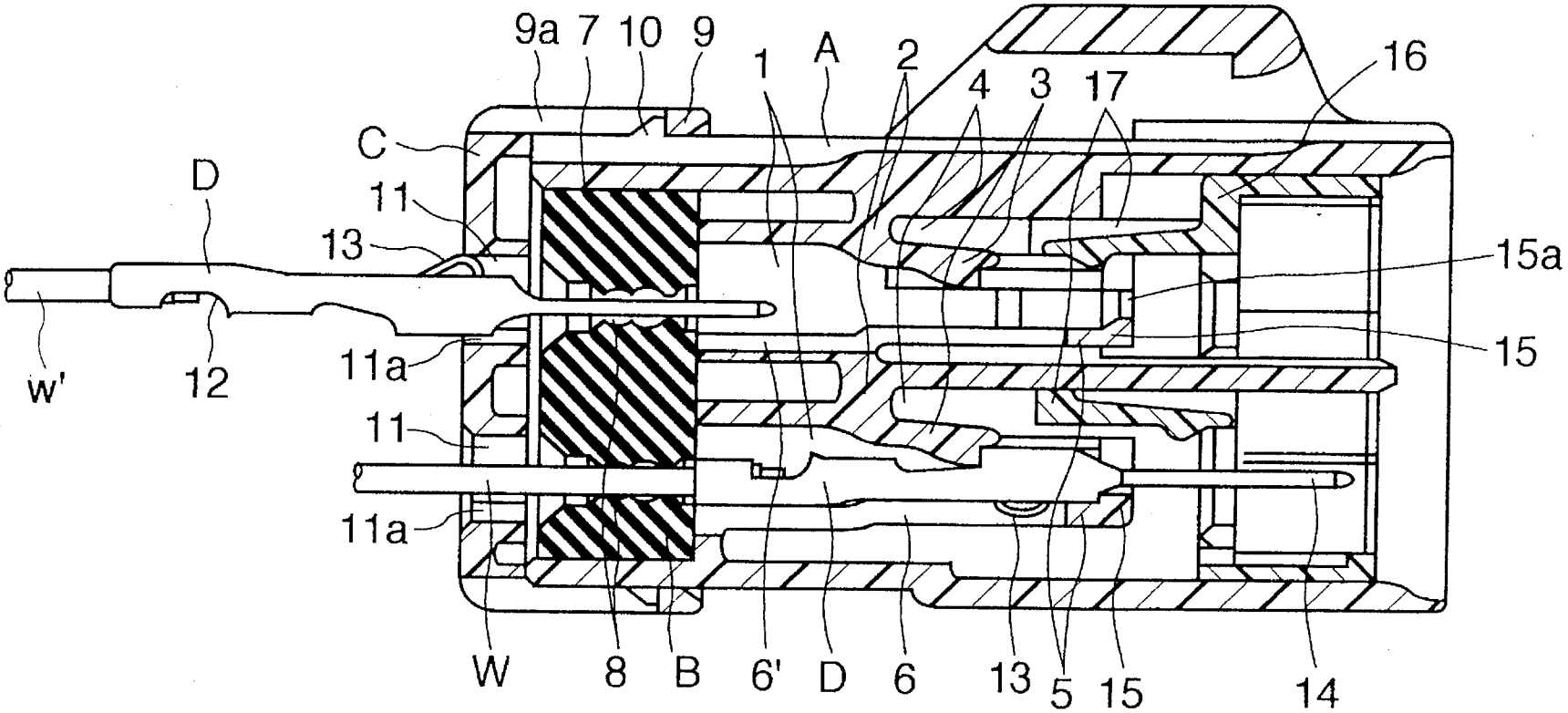
FIG. 2 is a sectional view taken along the line 2—2 of FIG. 1.
Figure 3:
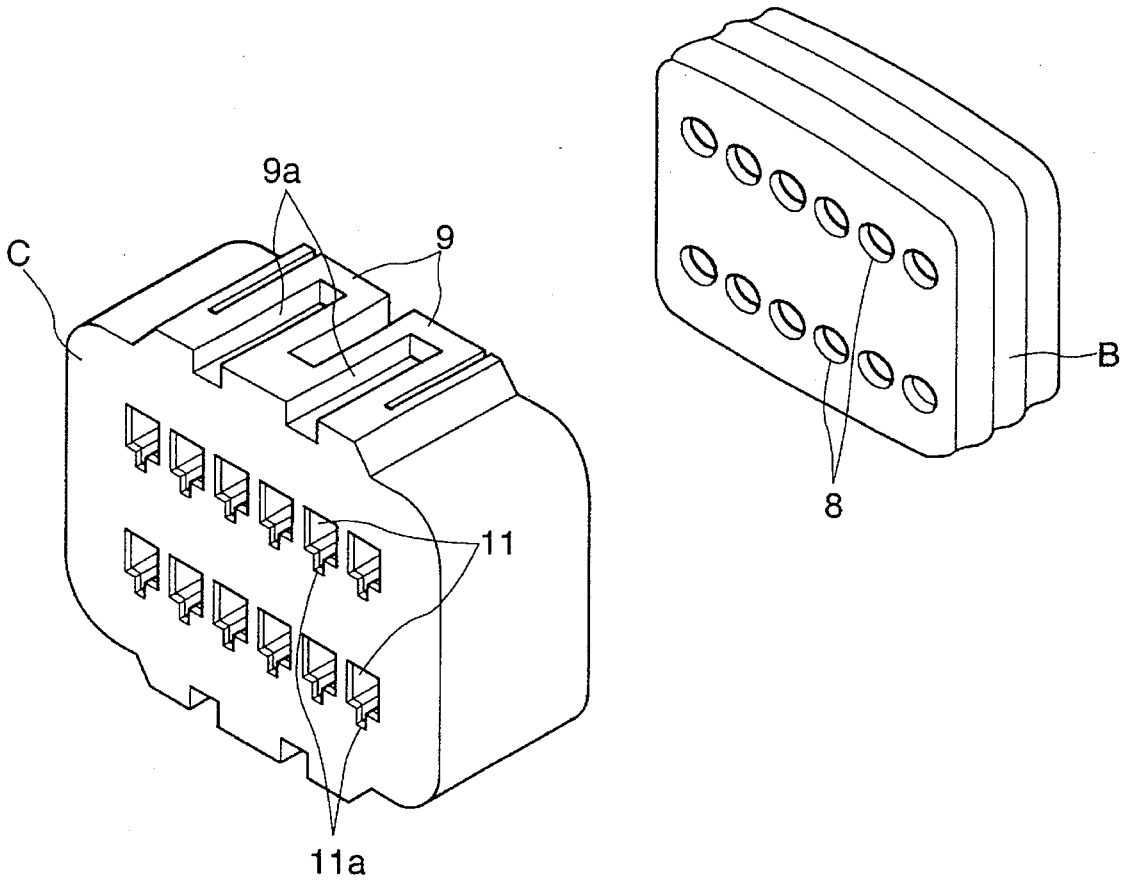
FIG. 3 is a perspective view of the waterproof plug and the waterproof plug retaining cover shown in FIGS. 1 and 2.

Referring to FIGS. 1 and 2, a waterproof connector according to the present invention includes a connector housing A whose rear end is open. A plurality of longitudinally extending terminal accommodating chambers 1 for accommodating male terminal members D are formed within the connector housing A. Each of the terminal accommodating chambers 1 is formed by a cylindrical member 15, and includes a front wall having a front opening, and an upper wall 2 having an integrally formed cantilever-like flexible lock member 3. A flexible displacement permitting space 4 is defined between the flexible lock member 3 and the upper wall 2. Each terminal accommodating chamber 1 further includes a bottom wall 5 having a guide groove 6' and a guide slit 6.

Formed on the rear side, i.e., the terminal insertion side, of the connector housing A is a fitting chamber 7 into which a waterproof plug B is fitted. The waterproof plug B, which is formed of an elastic material like rubber, is fitted into the fitting chamber of the housing, thereby realizing a waterproof sealing for the terminal members inserted into the terminal accommodating chambers. The waterproof plug B has a plurality of circular sealing insertion holes 8 respectively corresponding to the terminal accommodating chambers 1. The rear end section of the connector housing A is covered with a waterproof plug retaining cover C. Formed on the upper wall of the cover C are two flexible arms 9 each having an engagement hole 9*a*. Formed on the upper wall of the connector housing A, in turn, are two engagement projections 10, which are engaged with the engagement holes 9*a* so as to secure the cover C to the connector housing, thereby preventing the waterproof plug B from slipping off. The waterproof plug retaining cover C has rectangular insertion holes 11 respectively corresponding to the sealing insertion holes 8 of the waterproof plug B. The insertion holes 11 have inserting posture controlling recesses 11*a* for the terminal members D, which insertion holes are formed so as to be on the same side as the guide grooves 6' and the guide slits 6 in the terminal accommodating chambers 1.

Each terminal member D has a forwardly extending male-tab-like electrical contact portion 14 and an intermediate portion 12 having a relatively large diameter. An inserting posture controlling protrusion 13 is formed at the bottom of the intermediate portion 12.

In the above construction, the terminal member D, connected to an electric wire W beforehand, is inserted into one of the insertion holes 11 of the waterproof plug retaining cover C while keeping its inserting posture controlling protrusion 13 in alignment with the inserting posture controlling recess 11*a* of the insertion hole 11. Then, the terminal member D is passed through the corresponding sealing insertion hole 8 of the waterproof plug B until it enters the terminal accommodating chamber 1, which is formed by the cylindrical member 15 having a front opening 15*a*. The terminal member D, having thus entered the terminal accommodating chamber 1, is secured in position by engaging the shoulder of its intermediate portion 12 with the lock engaging member 3, with its electrical contact portion 14 protruding beyond the opening 15*a*. In this process, the above-mentioned protrusion 13 is shifted from the guide groove 6' to the guide slit 6 to be engaged with the latter, thereby stabilizing the posture of the terminal member D in the terminal accommodating chamber 1.

The connector housing A is equipped with terminal fastening members 16 having spacers 17. When the terminal member D in the half-engaged condition shown in FIG. 2 is forced into the connector housing A, the spacer 17 is brought into the flexible displacement permitting space 4, whereby the engagement of the terminal member D with the flexible lock member 3 is secured.

In accordance with the present invention, the inserting posture of the terminal members with respect to the waterproof connector can be reliably controlled in the earlier stages of insertion, so that the efficiency of the terminal member inserting operation can be enhanced. Further, since the inserting posture controlling protrusions provided on the terminal members engage with the guide grooves of the terminal accommodating chambers, the posture of the terminal members is stabilized.

What is claimed is:

1. A waterproof connector comprising:

a plurality of terminal members having inserting posture controlling protrusions;

a connector housing having a plurality of terminal accommodating chambers for accommodating said terminal members;

a waterproof plug having a plurality of sealing insertion holes corresponding to said terminal accommodating chambers and being fitted into a rear section of said connector housing;

a waterproof plug retaining cover mounted on an end of said rear section of said housing and having terminal insertion holes corresponding to said sealing insertion holes; and posture controlling recesses in each of said terminal insertion holes allowing passage of said inserting posture controlling protrusions formed on said terminal members, so that the inserting posture of the terminal members with respect to said waterproof connector can be reliably controlled in the earlier stages of insertion, thereby improving the efficiency of the terminal member inserting operation.

2. A waterproof connector according to claim 1 wherein a guide groove member is formed in said terminal accommodating chamber for guiding said inserting posture controlling protrusions of said terminal members.

3. A waterproof connector according to claim 2 wherein said guide groove member includes a slit adapted to engage with the inserting posture controlling protrusions of the completely inserted terminal members.

4. A waterproof connector according to claim 2 wherein each of said terminal accommodating chambers is formed by a cylindrical member extending along longitudinal dimension of said connector housing, and includes: a front wall portion having a front opening; an upper wall portion having a flexible engagement member; a lower wall portion having said guide groove member; and a rear, circular opening, wherein each of said terminal member includes: a male-tub-like electrical contact portion; a large diameter intermediate portion having said inserting posture controlling protrusion; and an electric wire connecting portion, and wherein, at the time of terminal insertion, said electrical contact portion extends forwardly from the front opening of said terminal accommodating chamber, said flexible engagement member of said terminal accommodating chamber engaging with the large diameter intermediate portion of said terminal member, said inserting posture controlling protrusion of said terminal member engaging with said guide groove member of said terminal accommodating chamber.

5. A waterproof connector according to claim 1 wherein the sealing insertion holes of said waterproof plug have a circular cross-sectional configuration, and wherein the terminal insertion holes of said waterproof plug retaining cover have a rectangular cross-sectional configuration.

6. A waterproof connector according to claim 1 wherein said waterproof plug retaining cover includes one or more flexible arms having engagement holes, and wherein said connector housing includes corresponding engagement projections so as to prevent the waterproof plug from slipping off.

7. A waterproof connector comprising:

terminal members each including a male-tab-like electrical contact portion, a large diameter intermediate portion having an inserting posture controlling protrusion, and an electric wire connecting portion;

a connector housing having a plurality of terminal accommodating chambers for accommodating said terminal members, each of said terminal accommodating chambers being formed by a cylindrical member which extends along longitudinal dimension of said connector housing, and including: a front wall portion having a front opening; an upper wall portion having a flexible engagement member on the inner side; a lower wall portion for guiding the inserted terminal member and a rear opening;

a waterproof plug having a plurality of circular sealing insertion holes corresponding to the rear openings of said terminal accommodating chambers and being fitted into a rear section of said connector housing; and a waterproof plug retaining cover mounted on an end of said rear section of said housing and having a plurality of rectangular terminal insertion holes corresponding to said sealing insertion holes, and posture controlling recesses in each of said terminal insertion holes allowing passage of said inserting posture controlling protrusions formed on said terminal members, so that the inserting posture of the terminal members with respect to said waterproof connector can be reliably controlled in the earlier stages of insertion, thereby improving the efficiency of the terminal member inserting operation.

8. A waterproof connector according to claim 7 wherein a guide groove member is formed in said lower wall portion of said cylindrical member in correspondence with said inserting posture controlling recesses in said terminal insertion holes of said waterproof plug retaining cover for guiding said inserting posture controlling protrusions of said terminal members.

9. A waterproof connector according to claim 8 wherein said guide groove member includes a slit adapted to engage with said inserting posture controlling protrusion of said completely inserted terminal member.

* * * * *